US011221194B2

(12) United States Patent
Lam et al.

(10) Patent No.: US 11,221,194 B2
(45) Date of Patent: Jan. 11, 2022

(54) IMULESS FLIGHT CONTROL SYSTEM

(71) Applicant: BAE SYSTEMS Information and Electronic Systems Integration Inc., Nashua, NH (US)

(72) Inventors: Quang M. Lam, Fairfax, VA (US); Michael J. Choiniere, Merrimack, NH (US); George M. Horihan, Staten Island, NY (US); David A. Richards, Merrimack, NH (US); Jason T. Stockwell, Brookline, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 165 days.

(21) Appl. No.: 16/163,793

(22) Filed: Oct. 18, 2018

(65) Prior Publication Data

US 2020/0124379 A1 Apr. 23, 2020

(51) Int. Cl.

*F41G 3/08* (2006.01)
*F41G 3/22* (2006.01)
*F42B 30/02* (2006.01)

(52) U.S. Cl.

CPC ..... *F41G 3/08* (2013.01); *F41G 3/22* (2013.01); *F42B 30/02* (2013.01)

(58) Field of Classification Search

CPC ..... F41G 3/08; F41G 3/22; F41G 3/14; F41G 3/142; F41G 3/145; F42B 30/02
USPC ..... 102/439
See application file for complete search history.

(56) References Cited

U.S. PATENT DOCUMENTS 8,120,526 B2 * 2/2012 Holder ..... G01S 13/003 342/140
8,854,252 B2 * 10/2014 Holder ..... G01S 13/003 342/107
9,401,741 B2 * 7/2016 Holder ..... H04B 1/7097
9,696,418 B2 * 7/2017 Holder ..... G01S 13/003
(Continued)

FOREIGN PATENT DOCUMENTS

WO 2007/016098 A2 2/2007
WO 2017072764 A1 4/2017

OTHER PUBLICATIONS

International Search Report, PCT/US19/55547, dated Jun. 19, 2020, 8 pages.

(Continued)

*Primary Examiner* — John Cooper
(74) *Attorney, Agent, or Firm* — KPIP Law, PLLC; Scott J. Asmus

(57) ABSTRACT

An integrated architecture and its associated sensors and processing software subsystems are defined and developed allowing a conventional unguided bullet to be transformed into a guided bullet without the use of an on-board inertial measurement unit (IMU). Some important SW components of the present disclosure include a target state estimator (TSE); a bullet state estimator (BSE); Multi-Object Tracking and Data Association; NTS GL; and a Data Link. Pre-conversion of two angles and range information of an OI sensor from spherical coordinates into Cartesian coordinates eliminates the Jacobian dependency in the H matrix for the BSE, thus increasing the miss distance performance accuracy of the bullet target engagement system.

5 Claims, 9 Drawing Sheets

(56) References Cited

U.S. PATENT DOCUMENTS

| | | | | |
|---|---|---|---|---|
| 2009/0237511 | A1* | 9/2009 | DeFlumere | H04N 5/33 348/164 |
| 2013/0192451 | A1* | 8/2013 | Scott | F41G 3/147 89/41.05 |
| 2013/0206896 | A1* | 8/2013 | Dicander | F42B 12/38 244/3.11 |
| 2014/0253368 | A1* | 9/2014 | Holder | G01S 7/354 342/146 |
| 2017/0314892 | A1* | 11/2017 | Holder | F41G 7/303 |
| 2018/0306563 | A1* | 10/2018 | Lotan | F41G 7/303 |
| 2021/0199752 | A1* | 7/2021 | Nguyen | F41G 7/2293 |

OTHER PUBLICATIONS

"Heterodyne", https://en.wikipedia.org/wiki/Heterodyne, known of at least since Apr. 24, 2019.

"Interferometry", https://en.wikipedia.org/wiki/Interferometry, known of at least since Apr. 24, 2019.

Monopulse radar, https://en.wikipedia.org/wiki/Monopulse radar, known of at least since Apr. 24, 2019.

"Pulse-Doppler signal processing", https://en.wikipedia.org/wiki/Pulse-Doppler_signal_processing, known of at least since Apr. 24, 2019.

"Undersampling", https://en.wikipedia.org/wiki/Undersampling, known of at least since Apr. 24, 2019.

Armin W. Doerry, "SAR Processing with Stepped Chirps and Phased Array Antennas", Sandia Report, Sandia National Laboratories, Printed Sep. 2006, Albuquerque, NM.

M. Mallick et al., "Angle-only filtering in 3D using Modified Spherical and Log Spherical Coordinates", 14th International conference on Information Fusion, Chicago, Illinois; pp. 1905-1912, Jul. 5-8, 2011.

K. Radhakrishnan et al., "Bearing only Tracking of Maneuvering Targets using a Single Coordinated Turn Model", International Journal of Computer Applications (0975-8887) vol. 1—No. 1, pp. 25-33; 2010.

* cited by examiner

IMULESS FLIGHT CONTROL SYSTEM

FIELD OF THE DISCLOSURE

The present disclosure relates to munitions guidance and control and more particularly to projectile control systems that can accomplish the navigation solution without requiring an on-board inertial measurement unit (IMU) in order to reconstruct the dynamic state vector of the munition as conventionally required by a typical navigation subsystem.

BACKGROUND OF THE DISCLOSURE

For weapon to engage with the target at an acceptable miss distance, two important sets of information are essentially required in order to feed the guidance subsystem to compute an effective commanded acceleration to guide the projectile or bullet onto a collision course with the target. Those two pieces of information are: (1) bullet/projectile state estimate (BSE or PSE) vector usually estimated by processing the on-board IMU measurements with an aided sensor such as GPS (aka, GPS/INS) and (2) target state estimate (TSE) vector computed using a Kalman filtering software processing measurements provided by a targeting sensor such as seeker or EO/IR camera. This disclosure presents an innovative scheme to achieve the PSE or BSE solution without explicitly employing an onboard IMU while still offering the degree of BSE/PSE solution accuracy for the guidance to steer the weapon onto the collision course with the target either static or in motion.

The IMUless flight control concept proposed in this disclosure is essentially required and motivated for the primary reason: there is no space and power available on a 30 mm bullet, or the like, to host any additional (add-on) IMU or aiding sensors like GPS or seeker onto the existing bullet. Therefore, the IMUless design concept presented herein serves as the technology enabler allowing the unguided 30 mm to be transformed into a guided bullet to satisfy the design objective from the size, weight, and power (SWAP) constraint compliance perspective.

Wherefore it is an object of the present disclosure to overcome the above-mentioned shortcomings and drawbacks associated with conventional projectile guidance systems.

SUMMARY OF THE DISCLOSURE

It has been recognized that Guidance, Navigation, and Control (GN&C) algorithms and technologies today are required to be tightly integrated with distributed communication and target tracking software systems in order to achieve a new performance objective for current and future guided projectiles. Those include performance and technology features that are highly adaptable to existing platforms without requiring any major/drastic changes or add-on of new components to its space requirements while still able to enhance or address the mission requirement at a higher level. IMUless flight control architecture and how the respective sensors and software components are configured to achieve the low cost guided munition design is one objective of this present disclosure.

One aspect of the present disclosure is the innovative architecture and high performance TSE and BSE algorithms integrated and configured with low cost sensors (i.e., Orthogonal Interferometry (OI) sensor and EO/IR camera) in an elegant way to address future munitions' stringent design requirements while achieving a better level of performance in the context of a single shot or circular error probable (CEP) (Monte Carlo simulation) miss distance.

A key contribution of this present disclosure is the OI sensor, the EO/IR camera, the observer based BSE, the angle only TSE, the nonlinear trajectory shaping (NTS) guidance law, and the data link. These main components essentially deliver the correct dynamic information allowing the flight control to achieve an acceptable engagement without explicitly requiring an onboard IMU, as described in herein.

The IMUless GN&C system presented in this disclosure has been demonstrated using a high fidelity bullet target engagement environment (captured in FIGS. 1, 3, and 4) to turn a low cost 30 mm bullet launched from a tank into a guided bullet and strike both ground-based targets and air-based targets (e.g., adversary UAVs, see FIG. 5) successfully. The design can also be applied to a UAV-based launching system as well.

Another aspect of the present disclosure is An IMUless projectile guidance, navigation, and control system, comprising: a platform, comprising: a sensor configured to detect and track multiple objects, including one or more targets and/or one or more projectiles; a Bullet State Estimator (BSE) module for processing data collected by the sensor relating to the location of the at least one projectile during flight; an angle only Target State Estimator (TSE) module for processing data collected by the sensor relating to the location of the one or more targets over time; a multiple objects detection, tracking, and data association module configured to identify which sensor signals belong to which of the multiple objects; and a data link configured to communicate information to the at least one projectile; the at least one projectile, comprising: an on-board sensor configured to detect and track the location of the at least one projectile during flight; an on-board data link receiver for receiving information from the platform regarding data from the platform Bullet State Estimator (BSE) and the platform Target State Estimator (TSE); an on-board sensor measurements processing module for processing on-board sensor data; an on-board Bullet State Estimator (BSE) module for processing data collected by the on-board sensor relating to the location of the at least one projectile during flight; an on-board nonlinear trajectory shaping guidance law module configured to process location information for the at least one projectile and the one or more targets using both on-board and platform sensor information; and on on-board control module configured to steer the at least one projectile into engagement with the one or more targets.

One embodiment of the IMUless projectile guidance, navigation, and control system is wherein the platform sensor is an electro-optical infrared (EO/IR) sensor.

Another embodiment of the IMUless projectile guidance, navigation, and control system is wherein the on-board sensor is a radio frequency orthogonal interferometry (RF/OI) sensor. In some cases, the platform is a vehicle.

Still another embodiment of the IMUless projectile guidance, navigation, and control system is wherein the one or more targets are ground-based, air-based, or both.

Yet another aspect of the present disclosure is an IMUless projectile guidance, navigation, and control method, comprising: detecting and tracking multiple objects, including one or more targets and/or one or more projectiles, via a sensor located on a platform; processing data collected by the sensor relating to the location of the at least one projectile during flight via a Bullet State Estimator (BSE) module located on the platform; processing data collected by the sensor relating to the location of the one or more targets over time via an angle only Target State Estimator (TSE)

module located on the platform; identifying which sensor signals belong to which of the multiple objects via a multiple objects detection, tracking, and data association module located on the platform; and communicating information to the at least one projectile via a data link located on the platform; detecting and tracking the location of the at least one projectile during flight via an on-board sensor; receiving information from the platform regarding data from the platform Bullet State Estimator (BSE) and the platform Target State Estimator (TSE) via an on-board data link receiver; processing on-board sensor data via an on-board sensor measurements processing module; processing data collected by the on-board sensor relating to the location of the at least one projectile during flight via an on-board Bullet State Estimator (BSE) module; processing location information for the at least one projectile and the one or more targets using both on-board and platform sensor information via an on-board nonlinear trajectory shaping guidance law module; and steering the at least one projectile into engagement with the one or more targets via an on-board control module.

One embodiment of the IMUless projectile guidance, navigation, and control method is wherein the platform sensor is an electro-optical infrared (EO/IR) sensor.

Another embodiment of the IMUless projectile guidance, navigation, and control method is wherein the on-board sensor is a radio frequency orthogonal interferometry (RF/OI) sensor. In some cases, the platform is a vehicle.

Still yet another embodiment of the IMUless projectile guidance, navigation, and control method is wherein the one or more targets are ground-based, air-based, or both.

These aspects of the disclosure are not meant to be exclusive and other features, aspects, and advantages of the present disclosure will be readily apparent to those of ordinary skill in the art when read in conjunction with the following description, appended claims, and accompanying drawings.

DETAILED DESCRIPTION OF THE DISCLOSURE

One embodiment of the system of the present disclosure employs external sensors and object estimation software to reconstruct the motion of a projectile and a target and close the Guidance and Control (G&C) loop to achieve a projectile to target engagement goal with an acceptable circular error probable (CEP) performance. A CEP is a measure of a weapon system's precision. It is defined as the radius of a circle, centered on the mean, whose boundary is expected to include the landing points of 50% of the rounds.

Figure 1:
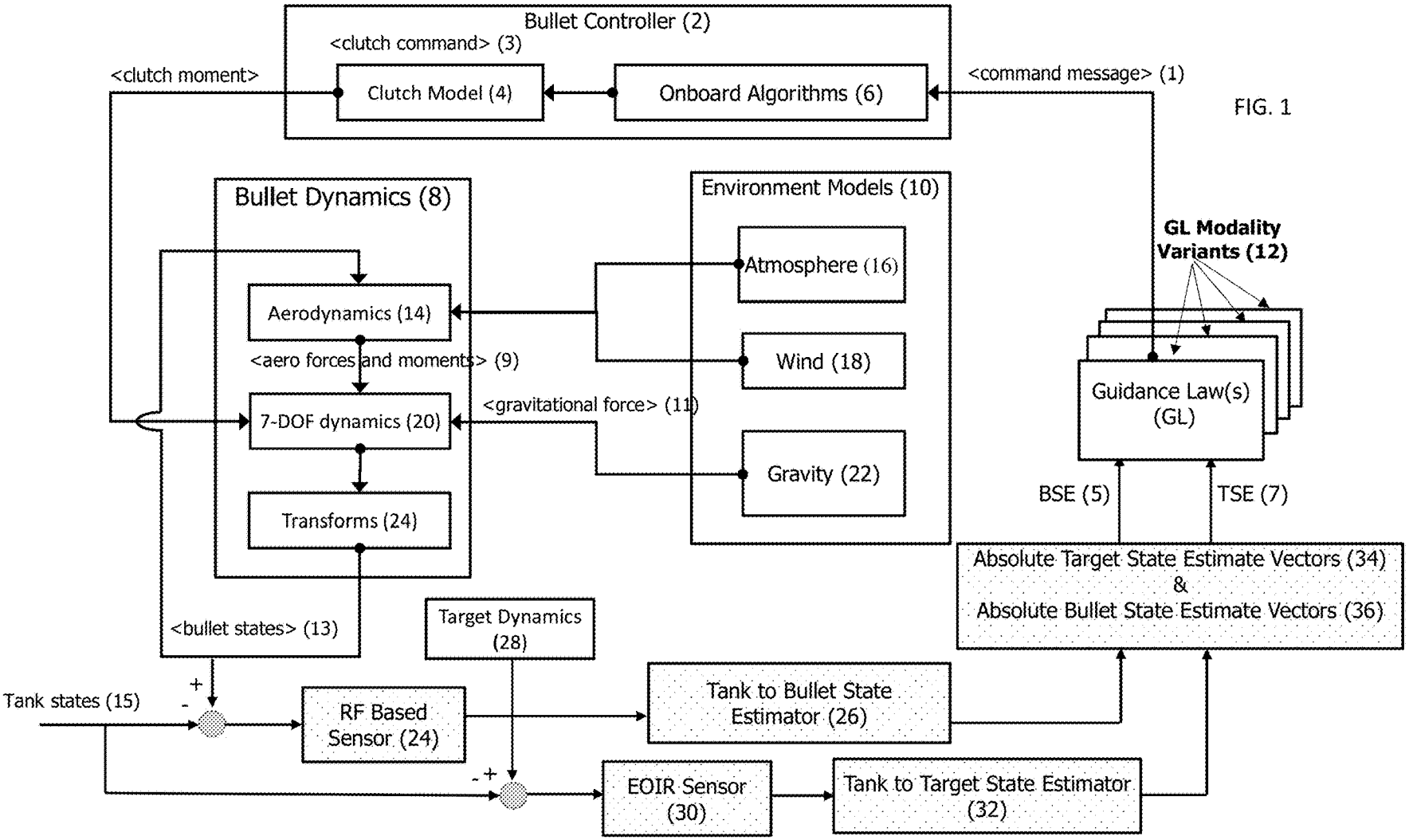
FIG. 1 is a diagram of one embodiment of a guidance and control system that does not use an inertial measuring unit to capture motion information for a guided projectile according to one embodiment of the present disclosure.

Referring to FIG. 1, a diagram of one embodiment of a guidance and control system that does not use an inertial measuring unit to capture motion information for a guided projectile according to one embodiment of the present disclosure is shown. There, the IMUless G&C architecture is integrated into the overall munition system. In some cases, the IMUless G&C architecture communicates with the ground-based fire control system via a data link implemented on a tank, for example.

Figure 2A:
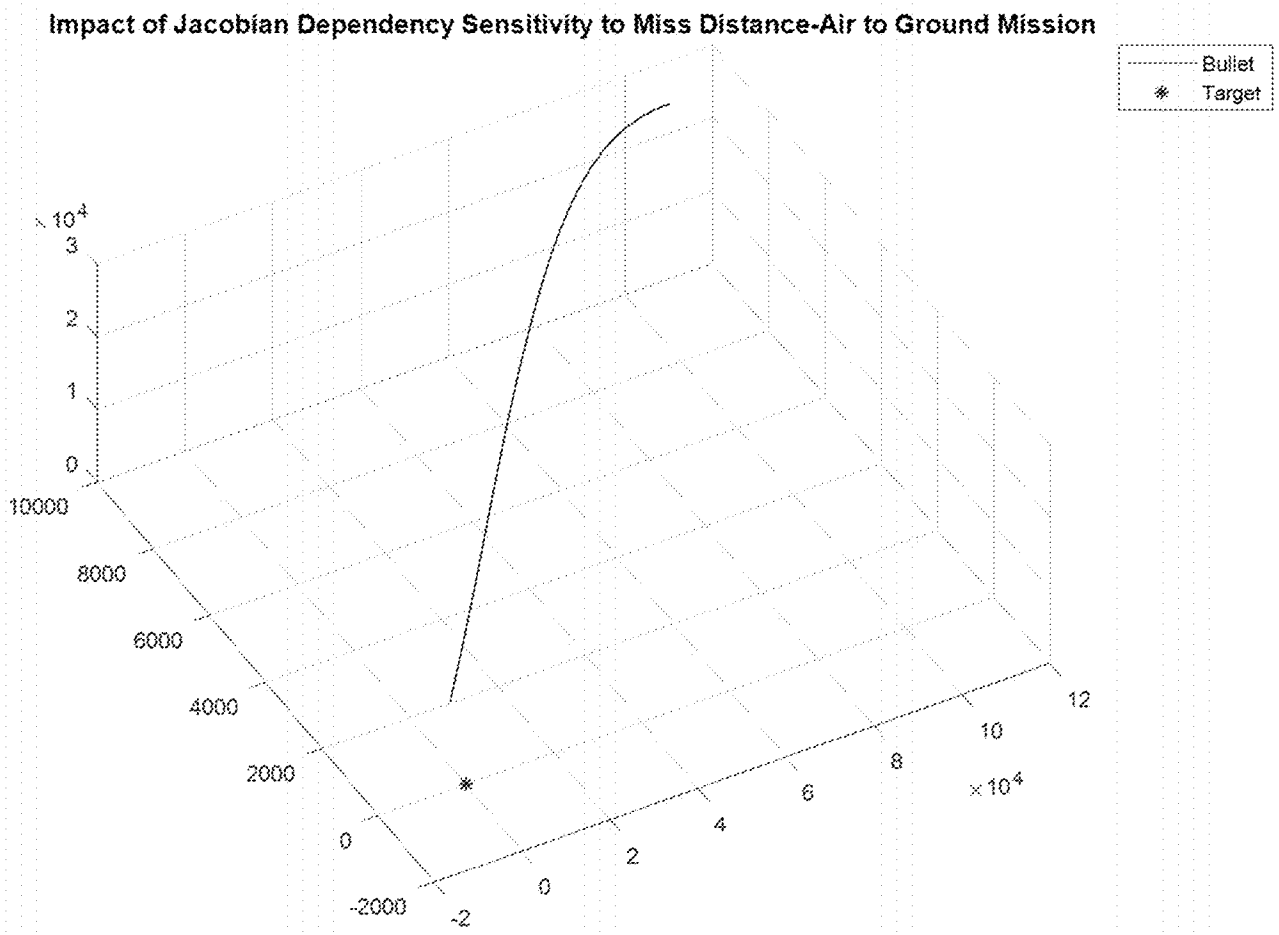
FIG. 2A shows the impact of Jacobian dependency sensitivity on miss distance for an air to ground mission according to the principles of the present disclosure.

Referring to FIG. 2A, the impact of Jacobian dependency sensitivity on miss distance for an air to ground mission is shown. In one embodiment, this serves as the motivation for the development of one component (i.e., active measurement pre-conversion software block) of the IMUless flight control architecture to eliminate the Jacobian dependency in the measurement matrix H.

$$\frac{\partial z}{\partial x} = H = \begin{bmatrix} \frac{\partial z_1}{\partial x_1} & \frac{\partial z_1}{\partial x_2} & \frac{\partial z_1}{\partial x_3} & \frac{\partial z_1}{\partial x_4} & \frac{\partial z_1}{\partial x_5} & \frac{\partial z_1}{\partial x_6} \\ \frac{\partial z_2}{\partial x_1} & \frac{\partial z_2}{\partial x_2} & \frac{\partial z_2}{\partial x_3} & \frac{\partial z_2}{\partial x_4} & \frac{\partial z_2}{\partial x_5} & \frac{\partial z_2}{\partial x_6} \\ \frac{\partial z_3}{\partial x_1} & \frac{\partial z_3}{\partial x_2} & \frac{\partial z_3}{\partial x_3} & \frac{\partial z_3}{\partial x_4} & \frac{\partial z_3}{\partial x_5} & \frac{\partial z_3}{\partial x_6} \end{bmatrix}$$

Where $z_1$=azimuth angle measurement; $z_2$=elevation angle measurement, and $z_3$=range measurement.

$$z_1 = \text{atan}\left(\frac{x_2}{x_1}\right) \tag{1}$$

$$z_2 = \text{atan}\left(\frac{x_3}{\sqrt{x_1^2 + x_2^2}}\right) \tag{2}$$

$$z_3 = \sqrt{x_1^2 + x_2^2 + x_3^2} \tag{3}$$

With $X_i$, i=1, 2, . . . , 6, . . . , 9 is the element of the TSE in Cartesian coordinate system.

Since the measurements $z_i$ (equations (1) to (3)) are a function of the first three states of the TSE, the last three columns of the H matrix will be equal to zero when taking the derivative of $z_i$ with respect to $X_i$, i=4, 5, 6, . . . , 9

$$\frac{\partial z}{\partial x} = H = \begin{bmatrix} \frac{\partial z_1}{\partial x_1} & \frac{\partial z_1}{\partial x_2} & \frac{\partial z_1}{\partial x_3} & 0 & 0 & 0 & 0 & 0 & 0 \\ \frac{\partial z_2}{\partial x_1} & \frac{\partial z_2}{\partial x_2} & \frac{\partial z_2}{\partial x_3} & 0 & 0 & 0 & 0 & 0 & 0 \\ \frac{\partial z_3}{\partial x_1} & \frac{\partial z_3}{\partial x_2} & \frac{\partial z_3}{\partial x_3} & 0 & 0 & 0 & 0 & 0 & 0 \end{bmatrix} \tag{4}$$

$$\frac{\partial z_1}{\partial x_1} = z_{11} = \frac{-x_2}{x_1^2\left(1+\left(\frac{x_2}{x_1}\right)^2\right)} \tag{5}$$

$$\frac{\partial z_1}{\partial x_2} = z_{12} = \frac{1}{x_1\left(1+\left(\frac{x_2}{x_1}\right)^2\right)} \tag{6}$$

$$\frac{\partial z_1}{\partial x_3} = z_{13} = z_{14} = z_{15} = z_{16} = 0 \tag{7}$$

$$\frac{\partial z_2}{\partial x_1} = z_{21} = \frac{-x_1 x_3}{\left(\frac{x_3^2}{x_1^2 \mid x_2^2}+1\right)(x_1^2+x_2^2)^{1.5}} \tag{8}$$

$$\frac{\partial z_2}{\partial x_2} = z_{22} = \frac{-x_2 x_3}{\left(\frac{x_3^2}{x_1^2+x_2^2}+1\right)(x_1^2+x_2^2)^{1.5}} \tag{9}$$

$$\frac{\partial z_2}{\partial x_3} = z_{23} = \frac{1}{\left(\frac{x_3^2}{x_1^2+x_2^2}+1\right)(x_1^2+x_2^2)^{0.5}} \tag{10}$$

$$\frac{\partial z_2}{\partial x_4} = z_{24} = z_{25} = z_{26} = 0 \tag{11}$$

$$\frac{\partial z_3}{\partial x_1} = z_{31} = \frac{x_1}{(x_1^2+x_2^2+x_3^2)^{0.5}} \tag{12}$$

$$\frac{\partial z_3}{\partial x_2} = z_{32} = \frac{x_2}{(x_1^2+x_2^2+x_3^2)^{0.5}} \tag{13}$$

$$\frac{\partial z_3}{\partial x_3} = z_{33} = \frac{x_3}{(x_1^2+x_2^2+x_3^2)^{0.5}} \tag{14}$$

$$\frac{\partial z_3}{\partial x_4} = z_{34} = z_{35} = z_{36} = 0 \tag{15}$$

To eliminate the sensitivity of the Jacobian term in the H matrix described above, a measurement is added to the pre-conversion block in front of the TSE as shown below by processing the sensor's two angles and range measurements into the TSE coordinate system, $$x_{1m} = r \cdot \cos(\theta)\cos(\phi) \tag{16}$$

$$x_{2m} = r \cdot \cos(\theta)\sin(\phi) \tag{17}$$

$$x_{3m} = r \cdot \sin(\theta) \tag{18}$$

where $\phi$ and $\theta$ are the azimuth and elevation angles, respectively and r is the slant range information from the object to the sensor. $X_{im}$, with i=1, 2, 3 is the measured object (either bullet or target) position vector in Cartesian TSE coordinate frame.

With the position measurements in Cartesian coordinate frame (instead of spherical coordinate, two angles and slant range of the sensor's original measurements), the sensor position measurements equation is now written as follows, $$ym = C \cdot x + v \tag{19}$$

where C is 3×9 matrix with no Jacobian dependency at all since it is directly related to the TSE position estimate vector in the same coordinate frame and v is the sensor noise.

$$C = \begin{bmatrix} 1 & 0 & 0 & 0 & 0 & 0 & 0 & 0 & 0 \\ 0 & 1 & 0 & 0 & 0 & 0 & 0 & 0 & 0 \\ 0 & 0 & 1 & 0 & 0 & 0 & 0 & 0 & 0 \end{bmatrix}$$

As shown above, the new measurement matrix in TSE Cartesian coordinate frame, C is a linear time invariant matrix with no Jacobian term dependency as shown in the original H matrix.

Figure 2B:
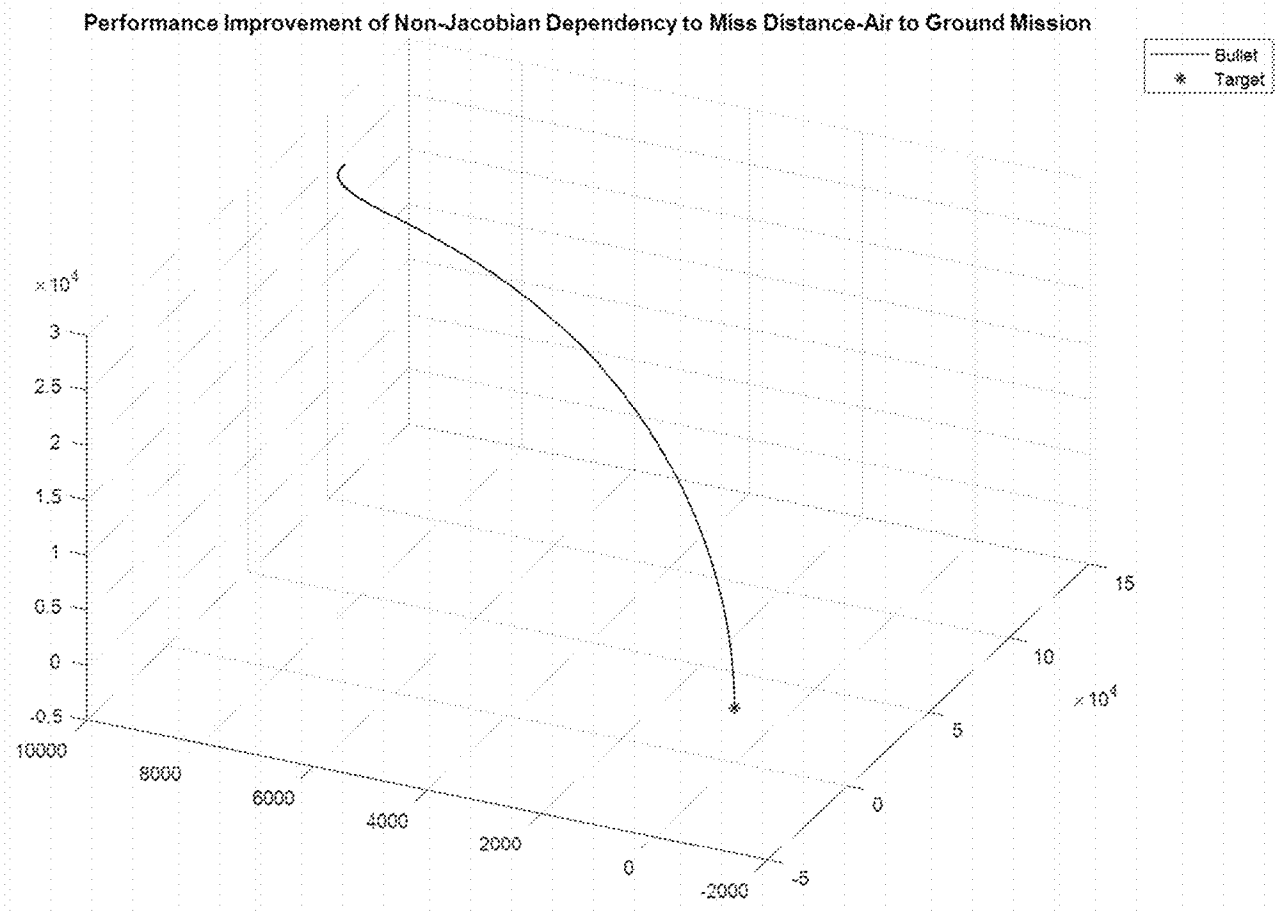
FIG. 2B illustrates a performance improvement of non-Jacobian dependency sensitivity on miss distance for an air to ground mission according to the principles of the present disclosure.

Using the new measurement matrix C via the pre-conversion block of the proposed IMUless architecture, the weapon to target engagement system exhibits a better performance as shown in FIG. 2B. FIG. 2B illustrates a performance improvement of non-Jacobian dependency sensitivity on miss distance for an air to ground mission.

Figure 3:
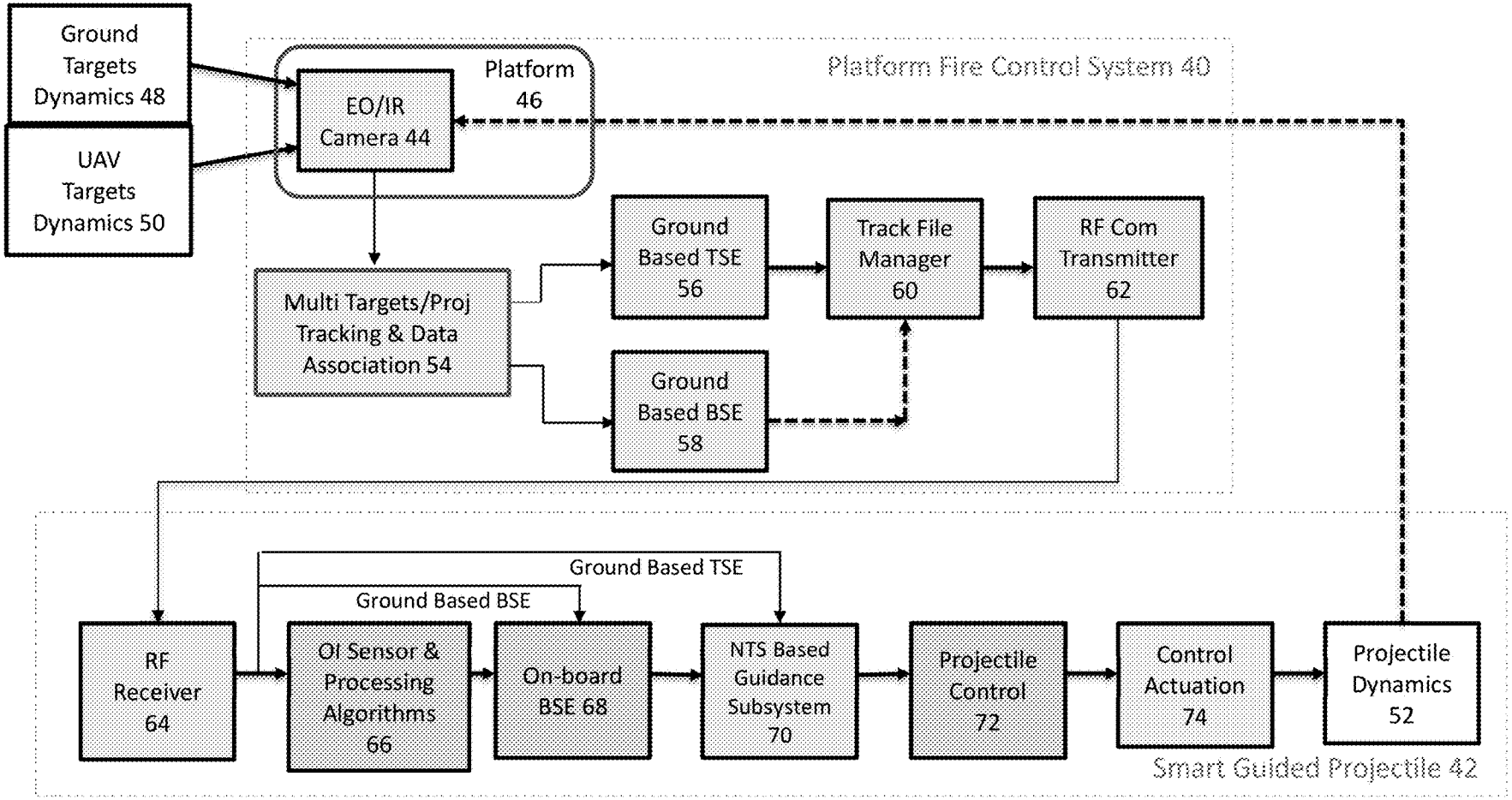
FIG. 3 is a diagram of components implemented on-board a projectile to enable the IMUless flight control system in one embodiment of the system of the present disclosure.

Referring to FIG. 3, one embodiment of the on-board subsystems of the present disclosure and their interfaces among subsystems onboard the projectile and the communication data link with the highlighted components of the fire control system IMUless flight control is shown. In one embodiment of the system, a platform fire control system 40 and a smart guided projectile portion are present. In some cases, an EO/IR camera 44 is located on a platform. In some cases, a platform is a vehicle, a ship, or the like. The EO/IR camera 44, or other sensor, detects dynamic information about ground-based targets 48, air-based targets 50, or both. Additionally, the EO/IR camera 44, or other sensor, detects dynamic information about the projectile 52. Within the platform fire control system 40, a multi-target/multi-projectile tracking and data association program 54 processes and analyzes data in order to attribute signals to the proper objects. In certain embodiments, a ground-based TSE 56 and a ground-based BSE 58 are present. In one embodiment, the TSE processes measurements that belong to the target and the TSE comprises a 6 state/9 state AO EKF). In one embodiment, the BSE processes measurements that belong to the projectile and the BSE utilizes an observer based design.

Still referring to FIG. 3, the ground-based TSE 56 and the ground-based BSE 58 provide input to a track file manager module 60 and this data is sent to the smart guided projectile 42 from a communication transmitter (e.g. RF) 62 to a receiver on the projectile 64 (e.g. RF). On-board the projectile is an OI sensor, or the like, and the respective processing algorithms 66. That output is used by an on-board BSE 68 and analyzed in reference to data form the ground-based BSE 58. The onboard BSE feeds into a NTS (non-liner trajectory shaping) guidance subsystem 70 along with data from the ground-based TSE 56. Projectile control 72 uses the accurate, up-to-date dynamic state information for the target and the projectile to actuate controls 74 on the projectile to change/maintain the projectile's direction along a flight path. This dynamic change in position over time (i.e. projectile dynamics 52) is detected by the sensor 44 of the platform fire control system 40 to complete the cycle.

Figure 4B:
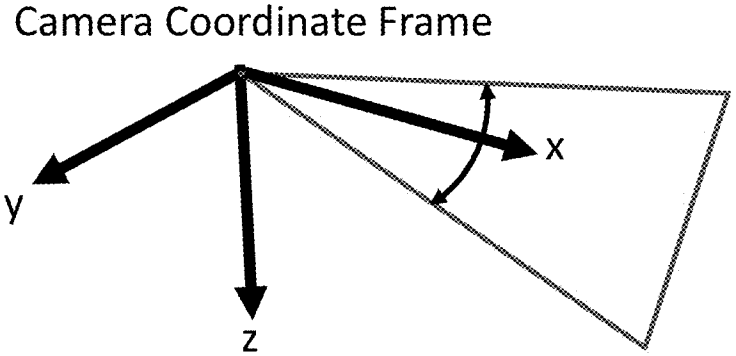
FIG. 4B shows one embodiment of a camera coordinate frame of the system of the present disclosure as shown in FIG. 4A.
Figure 4A:
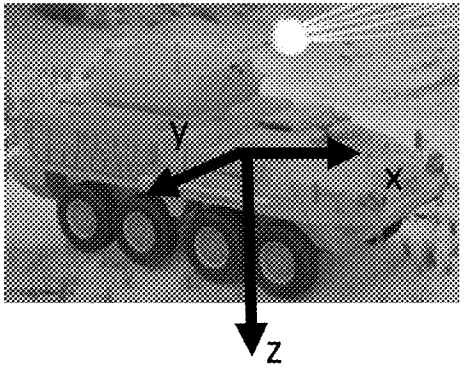
FIG. 4A shows one embodiment of the system of the present disclosure describing how the EO/IR camera mounted onto a platform.

Referring to FIG. 4A, one embodiment of the system of the present disclosure showing an EO/IR camera mounted onto a platform, e.g. a tank, as part of the ground based Fire Control System is shown. Referring to FIG. 4B, one embodiment of a camera coordinate frame of the system of the present disclosure as shown in FIG. 4A is shown. There, the EO/IR camera's boresight is along camera x, camera z is down (normal to the local surface) and camera y=z·x. In one embodiment, the camera FOV is ±10° about camera x. Tank x is positive out of the front of the vehicle, tank z is down (normal to the local surface) and tank y=z·x.

Figure 5A:
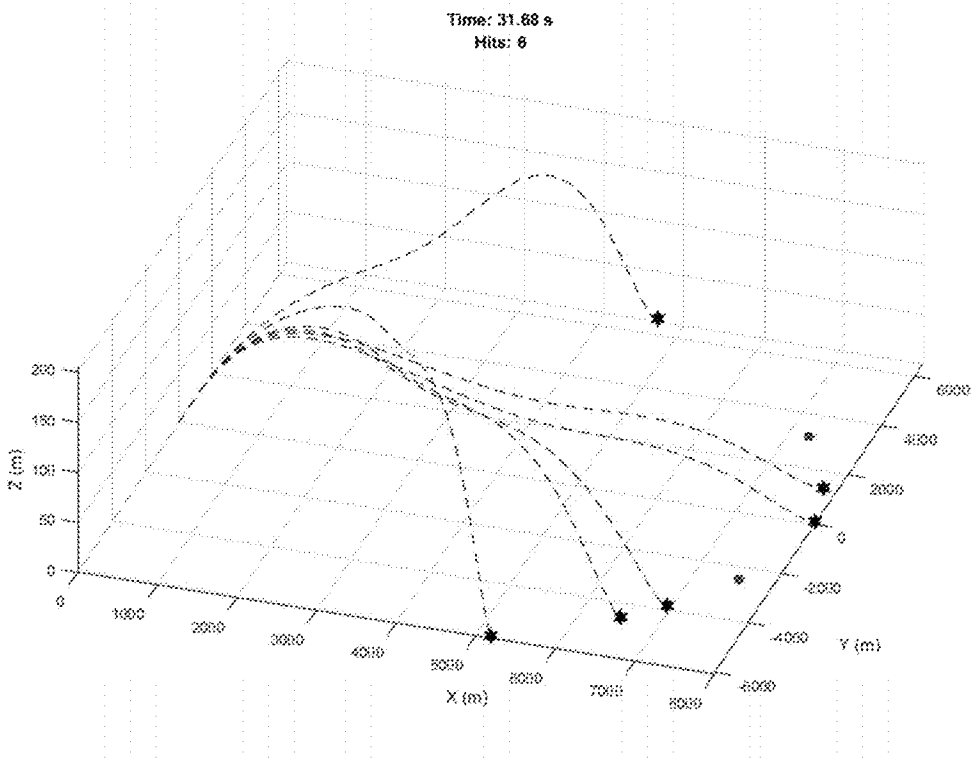
FIG. 5A shows ground-based multiple targets intercepted using an IMUless Guidance, Navigation, and Control (GN&C) according to the principles of the present disclosure.
Figure 5B:
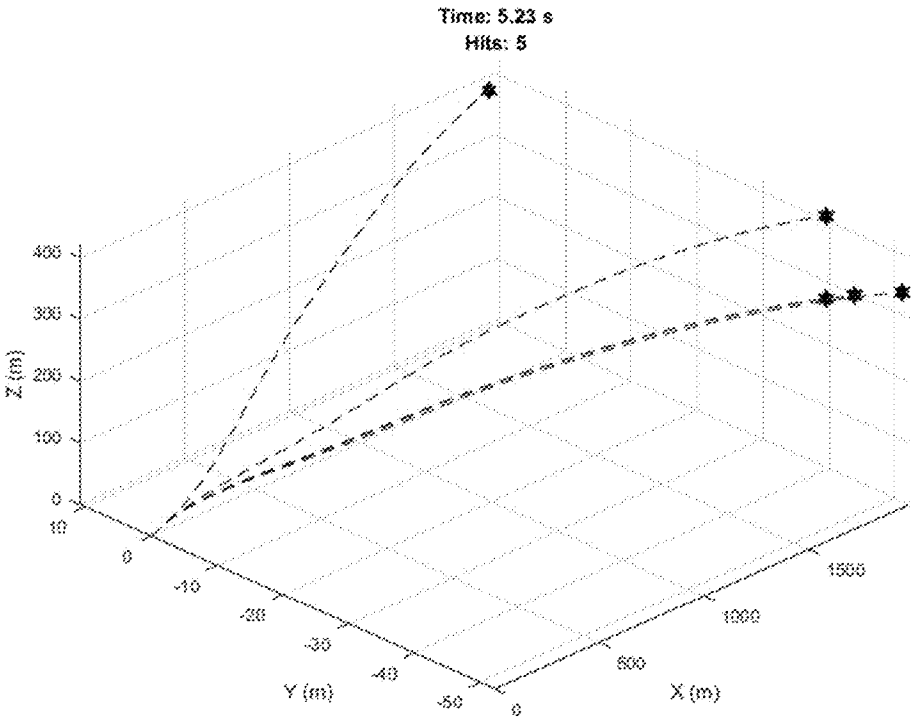
FIG. 5B shows air-based multiple targets intercepted using an IMUless Guidance, Navigation, and Control (GN&C) according to the principles of the present disclosure.

Referring to FIG. 5A, ground-based multiple targets intercepted using an IMUless Guidance, Navigation, and Control (GN&C) according to the principles of the present disclosure is shown. Referring to FIG. 5B, air-based multiple targets intercepted using an IMUless Guidance, Navigation, and Control (GN&C) according to the principles of the present disclosure. More specifically, in FIG. 5A, two objects were not hit as they were not intended targets.

Figure 6A:
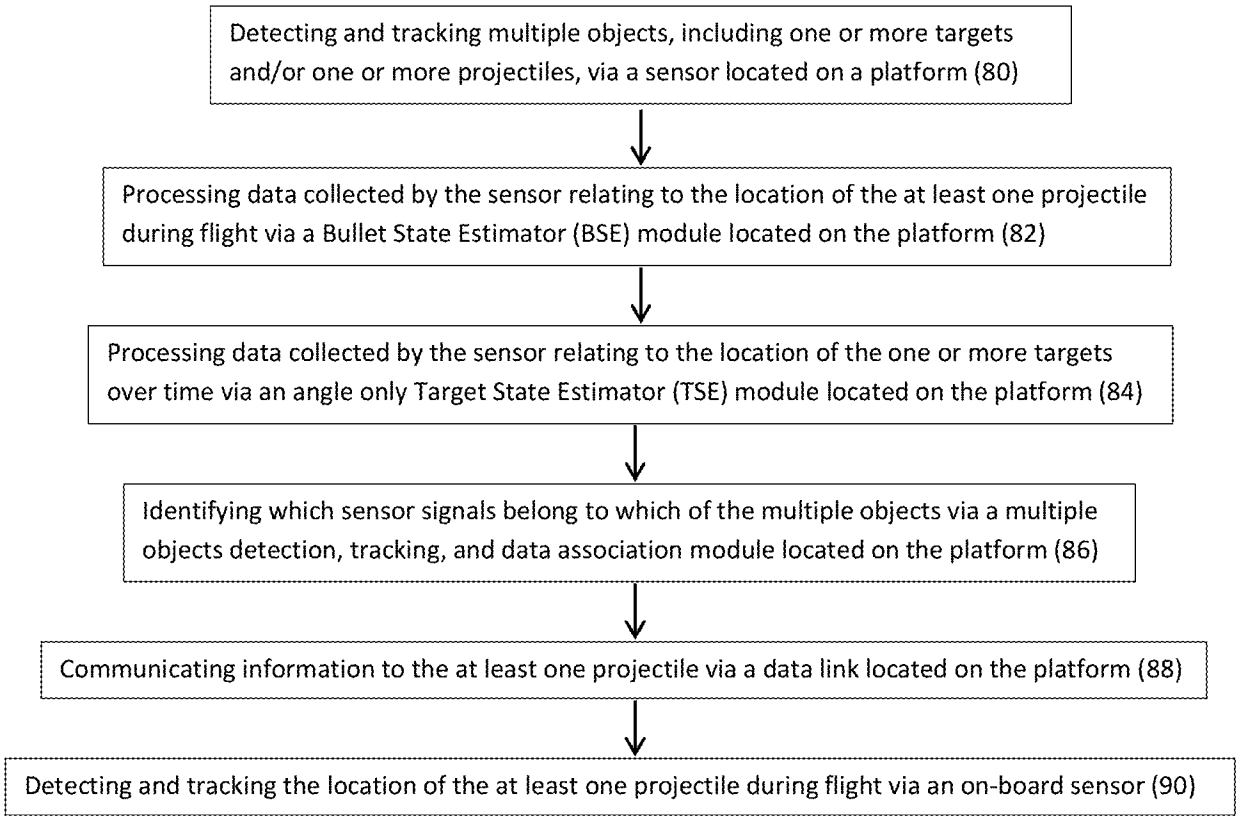
FIG. 6A is a flowchart of one embodiment of a method according to the principles of the present disclosure.

Referring to FIG. 6A, a flowchart of one embodiment of a method according to the principles of the present disclosure is shown. More specifically, an IMUless projectile guidance, navigation, and control method detects and tracks multiple objects, including one or more targets and/or one or more projectiles, via a sensor located on a platform 80. Data collected by the sensor relating to the location of the at least one projectile during flight is processed via a Bullet State Estimator (BSE) module located on the platform (82). Data collected by the sensor relating to the location of the one or more targets over time is processed via an angle only Target State Estimator (TSE) module located on the platform (84). A multiple objects detection, tracking, and data association module located on the platform identifies which sensor signals belong to which of the multiple objects (86). In one embodiment, information is communicated to the at least one projectile via a data link located on the platform (88). An on-board sensor detects and tracks the location of the at least one projectile during flight (90).

Figure 6B:
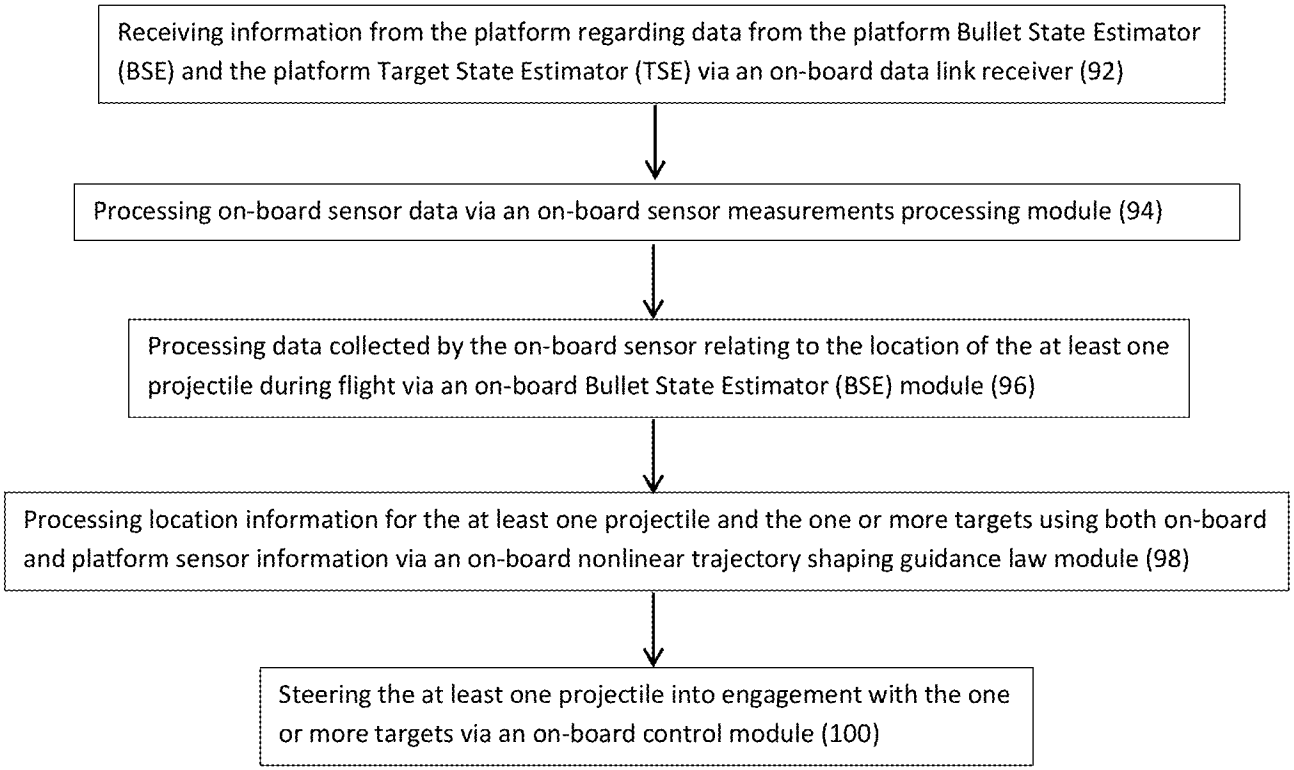
FIG. 6B is a flowchart of one embodiment of a method according to the principles of the present disclosure The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

Referring to FIG. 6B, a flowchart of one embodiment of a method according to the principles of the present disclosure is shown. In one embodiment of an IMUless projectile guidance, navigation, and control the method receives information from the platform regarding data from the platform Bullet State Estimator (BSE) and the platform Target State Estimator (TSE) via an on-board data link receiver (92). On-board sensor data is processed via an on-board sensor measurements processing module (94). Data collected by the on-board sensor relating to the location of the at least one projectile during flight is processed via an on-board Bullet State Estimator (BSE) module (96). Location information for the at least one projectile and the one or more targets is processed using both on-board and platform sensor information via an on-board nonlinear trajectory shaping guidance law module (98). In some cases, the at least one projectile is steered into engagement with the one or more targets via an on-board control module (100).

In one embodiment, the functional system (depicted in FIG. 3) employs several major design components to achieve an acceptable miss distance (MD) performance without explicitly requiring an on-board IMU. These major components, defined and integrated in a unique fashion, are functionally summarized as follows, 1) an active OI sensor designed to measure the motion of the bullet in an active manner with two angles and range measurements; 2) 9 state bullet state estimator (BSE) processing the OI sensor measurements and reconstructing the bullet state vector consisting of 9 state components (i.e., 3D position, 3D velocity, and 3D acceleration in Cartesian coordinate system); 3) an Electro Optical/Infrared (EO/IR) camera, or other sensor, implemented on the launching platform (e.g. tank or UAV) to capture multiple objects measurements (i.e., azimuth and elevation angles measurements of bullets or targets.), where FIG. 4A illustrates such an implementation of the EO/IR camera; 4) a robust angle only 9 state Target State Estimator (TSE) processing the EO/IR camera measurements; 5) a modern multiple object detection, tracking, and data association software block performing the front end measurements to individual TSE fusion or association so that each TSE can process the correct set of object measurements (seen by the EO/IR camera) in order to effectively maintain the individual object tracks feeding the NTS GL with the TSEs and its own bullet state estimate vectors (see, e.g., FIG. 5A where some objects were intentionally not hit); 6) a data link transmitter (implemented at the Fire Control Sensor) and receiver (onboard the bullet); 7) an onboard BSE to refine data using the uploaded BSE state vector information; and 8) a robust NTS GL to select the correct set of TSEs for guiding the bullet onto the collision course of the correct TSE. In certain embodiments, a 30 mm bullet design, or the like, with its onboard autopilot along with its control actuation system (CAS) are re-purposed as commercial off the shelf components to implement the system of the present disclosure.

In yet another embodiment, a two estimators design (BSE and TSE) using a robust Extended Kalman Filter (EKF) algorithm is used. This embodiment processes active and passive sensors' measurements to accurately reconstruct the 3D dynamic motion of both target and bullet platforms while two sensors are residing in a third platform. This embodiment would be applicable to the automated driving assistant system (ADAS) market in the following context. The ability to detect and track both bullet and target (i.e., multiple objects detection and tracking) and steering them into a collision course presented in this disclosure can be applied in a "reverse order", i.e., instead of interception now autonomously maintaining them to stay away from each other in a safe separation distance, thus serving the collision avoidance purpose of the ADAS market.

Referring to FIG. 1, a diagram of one embodiment of an IMUless guidance and control system that does not use an on-board IMU to capture the dynamic motion of a guided projectile according to one embodiment of the present disclosure is shown. In other words, the BSE 5 does not need an IMU while still able to reconstruct the motion of the bullet or projectile. A bullet controller 2 comprising a clutch model 4. The clutch model 4 receives command messages 1 from a guidance law variant module (12) fed via the bullet state estimator (BSE) 5 and a target state estimator (TSE) 7. The bullet controller 2 drives the bullet via clutch commands 3 operated via on-board algorithms 6.

Still referring to FIG. 1, bullet dynamics information 8 is fed in part by environmental models 10 into the BSE 5 and TSE 7. In one example, an aerodynamics module 14 is fed by an atmosphere model 16 and a wind model 18. These aero forces and moments 9 are fed into a 7 degree of freedom (DOF) module along with gravitational forces 11 from a gravity module 22, which in turn is running a gravity model. In certain embodiments, the gravity model is a gravity model. The bullet dynamics data is then run through a transform module 24 to convert the data into a particular coordinate system in order to represent the various bullet states 13 used in the system of the present disclosure.

In one embodiment, on a tank e.g., Stryker, the truth bullet states 13 and the truth Stryker states 15 are used to derive relative inputs information (i.e., from bullet state dynamic to Stryker state dynamic) to drive the RF based sensor 24 mounted on the Stryker's platform (a US Army Tank). This RF sensor measurement will be used as inputs to the bullet state estimator (BSE) module 26. This BSE essentially serves as the navigation solution estimating the bullet dynamic motion without explicitly requiring an onboard IMU for the bullet, thus giving rise to the IMUless flight control system, the subject of this disclosure. Target dynamics 28 are fed into an EO/IR sensor 30, which then provides input for a Stryker to target state estimator module 32 here called TSE from hereon in. Both BSE and TSE solutions will be used to feed a guidance law (GL) block 12 to compute the right commanded acceleration steering the bullet onto a collision course with the target. The striker to target state estimator module 32 is processed to form absolute target state estimate vectors 34, the calculation of which includes the EOIR/OI's IMU information and absolute bullet state estimate vectors 36. These vectors are used by the variants of the guidance laws 12 for the particular application. Via the data link, the GL commanded acceleration will be processed to derive the commanded control signal to deflect the actuator/strake angle to achieve the needed force and moment to steer the bullet onto a collision course with the target.

In one embodiment of the system of the present disclosure, for EO/IR measurements, similar derivations are used except that the range information is unavailable. There, EO/IR angles measurements are fed into the EO/IR based TSE State EKF and the relative motion states according to [rT-rEO (3-D)], [vT-vEO (3-D)] and [aT-aEO (3-D)] are combined with the motion states [rB-rOI (3-D)], [vB-vOI (3-D)], and [aB-aOI (3-D)] based on the OI/RF angles and derived range measurements (via a communication link, or the like) that are fed into an OI/RF based BSE 9 state EKF. The combined EOIR/OI motion state vectors are estimated by the EOIR/OI system (e.g., [rT-rB (3-D)], [vT-vB (3-D)], and [aT-aB (3-D)], i.e., target to bullet 9 state vector), where an initial assumption is that the EOIR/OI are collocated, thus making relative dynamics from target to projectile quite straightforward. The 9 state relative vector estimates from target to bullet (or projectile) information are then used to feed the GL to compute the right commanded acceleration steering the bullet/projectile onto the right collision course with the target.

In another embodiment, a unique design for a nine (9) state EKF eliminates the Jacobian matrix dependency often required for EOIR and projectile trackers. In this embodiment, RF sensor measurements are pre-converted from spherical coordinates (two angles and range) to Cartesian coordinates (CC) so that both EKF state vector and sensor measurements are captured in the same CC frame. Therefore, the Jacobian matrix that would have been used becomes a time invariant matrix (i.e., there are no more partial derivative dependencies).

It is important to note that a Jacobian dependency sensitivity impacts on miss distance performance for an air to ground mission as shown in FIG. 2A. The more accurate unique EKF design of the present disclosure is shown in FIG. 2B. There a clear performance improvement is being accomplished by the no Jacobian dependency technique developed in this present disclosure.

Referring to FIG. 3, one embodiment of the system of the present disclosure with the interface between the projectile and the fire control system highlighting key components allowing IMUless flight control is shown. More specifically the multi target multi bullet (or projectile) detection, tracking, and data association software block serves as the real-time (external) sensing system monitoring the bullet target engagement conditions and alert the bullet via the guidance law selection for which target it should be engaging with.

Referring to FIG. 4, one embodiment of the system of the present disclosure shown therein is the implementation architecture per bullet with respective subsystems allowing the IMUless GN&C to accomplish missions at a practical level (see FIG. 5A and FIG. 5B for an example of multiple surface-based and air-based target engagement.

The computer readable medium as described herein can be a data storage device, or unit such as a magnetic disk, magneto-optical disk, an optical disk, or a flash drive. Further, it will be appreciated that the term "memory" herein is intended to include various types of suitable data storage media, whether permanent or temporary, such as transitory electronic memories, non-transitory computer-readable medium and/or computer-writable medium.

It will be appreciated from the above that the invention may be implemented as computer software, which may be supplied on a storage medium or via a transmission medium such as a local-area network or a wide-area network, such as the Internet. It is to be further understood that, because some of the constituent system components and method steps depicted in the accompanying Figures can be implemented in software, the actual connections between the systems components (or the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. An IMUless projectile guidance, navigation, and control system, comprising:

a platform, comprising:

an Electro-Optical/Infrared (EO/IR) sensor configured to detect and track multiple objects, including one or more targets and/or one or more projectiles;

a Bullet State Estimator (BSE) module for processing data collected by the sensor relating to the location of the at least one projectile during flight, wherein the BSE processing includes a 9 state Extended Kalman Filter (EKF);

an angle only Target State Estimator (TSE) module for processing data collected by the sensor relating to the location of the one or more targets over time, wherein the TSE processing includes a 9 state Extended Kalman Filter (EKF), a multiple objects detection, tracking, and data association module configured to identify which sensor signals belong to which of the multiple objects;

the at least one projectile, comprising:

an on-board radio frequency orthogonal interferometry (RF/OI) sensor configured to detect and track the location of the at least one projectile during flight;

an on-board RF receiver for receiving information from an RF transmitter on the platform regarding data from the Bullet State Estimator (BSE) and the angle only Target State Estimator (TSE);

an on-board sensor measurements processing module for processing on-board sensor data;

an on-board Bullet State Estimator (BSE) module for processing data collected by the on-board sensor relating to the location of the at least one projectile during flight;

an on-board nonlinear trajectory shaping guidance law module configured to process location information for the at least one projectile and the one or more targets using both on-board and platform sensor information; and on on-board control module configured to steer the at least one projectile into engagement with the one or more targets without using an on-board IMU.

2. The IMUless projectile guidance, navigation, and control system according to claim 1, wherein the platform is a vehicle.

3. The IMUless projectile guidance, navigation, and control system according to claim 1, wherein the one or more targets are ground-based, air-based, or both.

4. The IMUless projectile guidance, navigation, and control system according to claim 1, wherein the location of the at least one projectile from the on-board BSE module is in a 3D position, 3D velocity, and 3D acceleration in a Cartesian coordinate system.

5. A projectile guidance, navigation, and control system, comprising:

a ground or air based fire control platform, comprising:

at least one electro-optical/infrared (EO/IR) sensor configured to detect and track multiple objects, including one or more targets and/or one or more projectiles;

a platform Bullet State Estimator (BSE) module for processing data collected by the sensor relating to the location of the at least one projectile during flight, wherein the platform BSE includes processing by a 9 state Extended Kalman Filter (EKF);

a platform Target State Estimator (TSE) module for processing data collected by the sensor relating to the location of the one or more targets over time, wherein the platform TSE includes processing by a 9 state Extended Kalman Filter (EKF);

a multiple objects detection, tracking, and data association module configured to identify which sensor signals belong to which of the multiple objects;

an RF transmitter for communicating platform information;

the at least one projectile, comprising:

an on-board radio frequency orthogonal interferometry (RF/OI) sensor configured to detect and track the location of the at least one projectile during flight;

an on-board RF receiver for receiving information from the platform regarding data from the platform Bullet State Estimator (BSE) and the platform Target State Estimator (TSE);

an on-board sensor measurements processing module for processing sensor data from the RF/OI sensor;

an on-board Bullet State Estimator (BSE) module for processing data collected by the on-board RF/OI sensor relating to the location of the at least one projectile in a 3D position, 3D velocity, and 3D acceleration in a Cartesian coordinate system;

an on-board nonlinear trajectory shaping guidance law module configured to process location information for the at least one projectile and the one or more targets using both on-board and platform sensor information; and on on-board control module configured to steer the at least one projectile into engagement with the one or more targets without using an on-board IMU.

* * * * *